US010307781B2

(12) United States Patent
Jayasuriya et al.

(10) Patent No.: US 10,307,781 B2
(45) Date of Patent: Jun. 4, 2019

(54) VEHICLE COMPONENT FABRICATION

(71) Applicant: Ford Global Technologies, LLC, Dearborn, MI (US)

(72) Inventors: Mangala A. Jayasuriya, Bloomfield Hills, MI (US); James Chih Cheng, Troy, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 230 days.

(21) Appl. No.: 14/966,357

(22) Filed: Dec. 11, 2015

(65) Prior Publication Data

US 2017/0165698 A1 Jun. 15, 2017

(51) Int. Cl.

| | |
|---|---|
| ***B05B 13/02*** | (2006.01) |
| ***B05B 13/04*** | (2006.01) |
| ***B05B 9/00*** | (2006.01) |
| ***B05C 5/02*** | (2006.01) |
| ***C23C 4/123*** | (2016.01) |
| *B05D 1/26* | (2006.01) |

(52) U.S. Cl.

CPC ..... *B05B 13/0431* (2013.01); *B05B 9/002* (2013.01); *B05B 13/0285* (2013.01); *B05C 5/0204* (2013.01); *C23C 4/123* (2016.01); *B05D 1/26* (2013.01)

(58) Field of Classification Search

None

See application file for complete search history.

(56) References Cited

U.S. PATENT DOCUMENTS

| | | | | |
|---|---|---|---|---|
| 2,252,431 | A * | 8/1941 | Klammt | B27G 11/00 118/411 |
| 4,165,869 | A * | 8/1979 | Williams | B25B 5/003 269/154 |
| 4,747,588 | A * | 5/1988 | Dillhoff | B25B 5/12 269/258 |
| 5,340,433 | A | 8/1994 | Crump | |
| 6,595,263 | B2 | 7/2003 | Grinberg et al. | |
| 6,722,872 | B1 | 4/2004 | Swanson et al. | |
| 6,749,414 | B1 | 6/2004 | Hanson et al. | |
| 6,776,602 | B2 | 8/2004 | Swanson et al. | |
| 8,827,684 | B1 | 9/2014 | Schumacher et al. | |
| 2009/0263582 | A1 | 10/2009 | Batchelder | |

(Continued)

FOREIGN PATENT DOCUMENTS

| | | | |
|---|---|---|---|
| CN | 103465636 | A | 12/2013 |
| CN | 203779870 | U | 8/2014 |

(Continued)

OTHER PUBLICATIONS

GB UK Search Report 16476P; GB Appl No. GB1620864.7 dated May 5, 2017; 5 pages.

(Continued)

*Primary Examiner* — Charles Capozzi

(74) *Attorney, Agent, or Firm* — Brandon Hicks; Bejin Bieneman PLC

(57) ABSTRACT

A system includes an injector including a robotic arm and a heated chamber. The injector includes a material feed and a heating element. The robotic arm is arranged to deposit the material feed onto a vehicle component in the heated chamber.

13 Claims, 11 Drawing Sheets

(56) References Cited

U.S. PATENT DOCUMENTS

| | | | | |
|---|---|---|---|---|
| 2012/0180718 | A1* | 7/2012 | Martin | B05C 5/0204 118/108 |
| 2015/0132425 | A1* | 5/2015 | Lacaze | B29C 67/0088 425/144 |
| 2016/0200047 | A1* | 7/2016 | Mark | B29C 70/20 264/148 |

FOREIGN PATENT DOCUMENTS

| | | | |
|---|---|---|---|
| EP | 1302269 | A2 | 4/2003 |
| EP | 1543908 | A2 | 6/2005 |
| EP | 1614526 | B1 | 8/2007 |

OTHER PUBLICATIONS

Bengtson, "EDAG Genesis, 3D Printed Concept Car Unveiled", Mar. 3, 2014, http://3dprint.com/1410/edag-genesis-3d-printed-concept-car-unveiled, 3 pages.

Weiss, "World's first 3D-printed supercar aimed at shaking up the auto industry", Jul. 9, 2015, http://www.gizmag.com/divergent-microfactories-blade-first-3d-printed-supercar/38201, 10 pages.

Woollaston, "Print your own car in less than TWO DAYS . . . ", Oct. 8, 2014, http://www.dailymail.co.uk/sciencetech/article-2784792/Print-car-TWO-DAYS-World-s-, 15 pages.

* cited by examiner

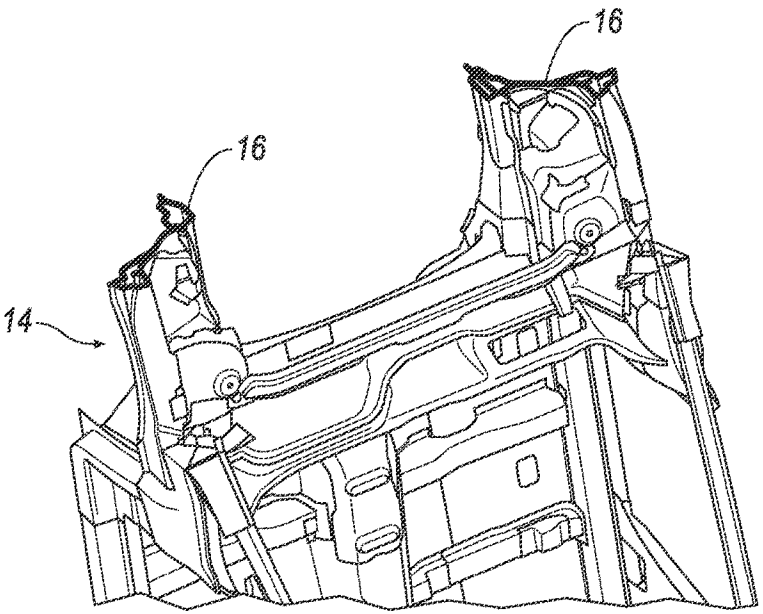
FIG. 5B
FIG. 5A
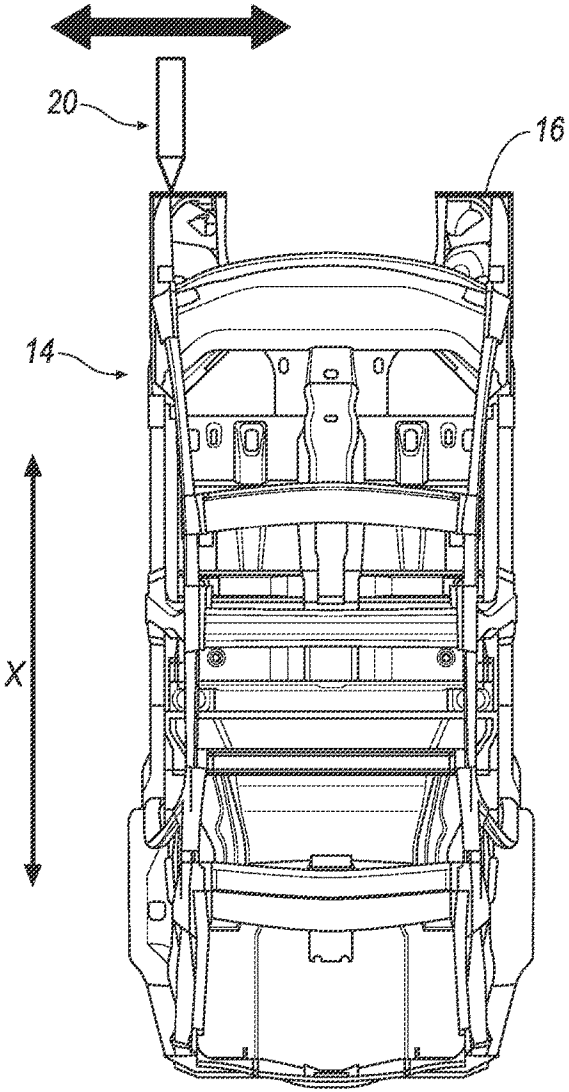

VEHICLE COMPONENT FABRICATION

BACKGROUND

Components in vehicle bodies often include of several hundred parts tooled from larger pieces of material and joined with spot welds. Spot welds in general cannot join parts of dissimilar materials. Building vehicle components from several parts may be therefore be costly and unwieldy.

BRIEF DESCRIPTION OF THE DRAWINGS

FIG. 5A is a view of the system of FIG. 1 forming a component where the component is rotated such that its X-axis is vertical.

FIG. 5B is an expanded view of the component of FIG. 5A.

DETAILED DESCRIPTION

Constructing vehicle components from deposited layers of material as disclosed herein offers several advantages. By constructing the components with individual layers of material, spot welds are generally unnecessary to join various components and/or parts of components. Because a component is constructed as a unitary construction according to the present disclosure, the component may be more robust than a component that comprises a plurality of parts welded or otherwise joined together. Further, a number of parts necessary to construct a vehicle body can be reduced, and an overall cost of vehicle production may be minimized. By depositing layers of differing materials, vehicle components can be constructed with material structures not typically able to be easily joined, e.g., steel and aluminum. Furthermore, the component may be manufactured with fewer or no weld flanges and allow for variable thicknesses in the component, which may result in an aesthetically appealing vehicle body.

Figure 1:
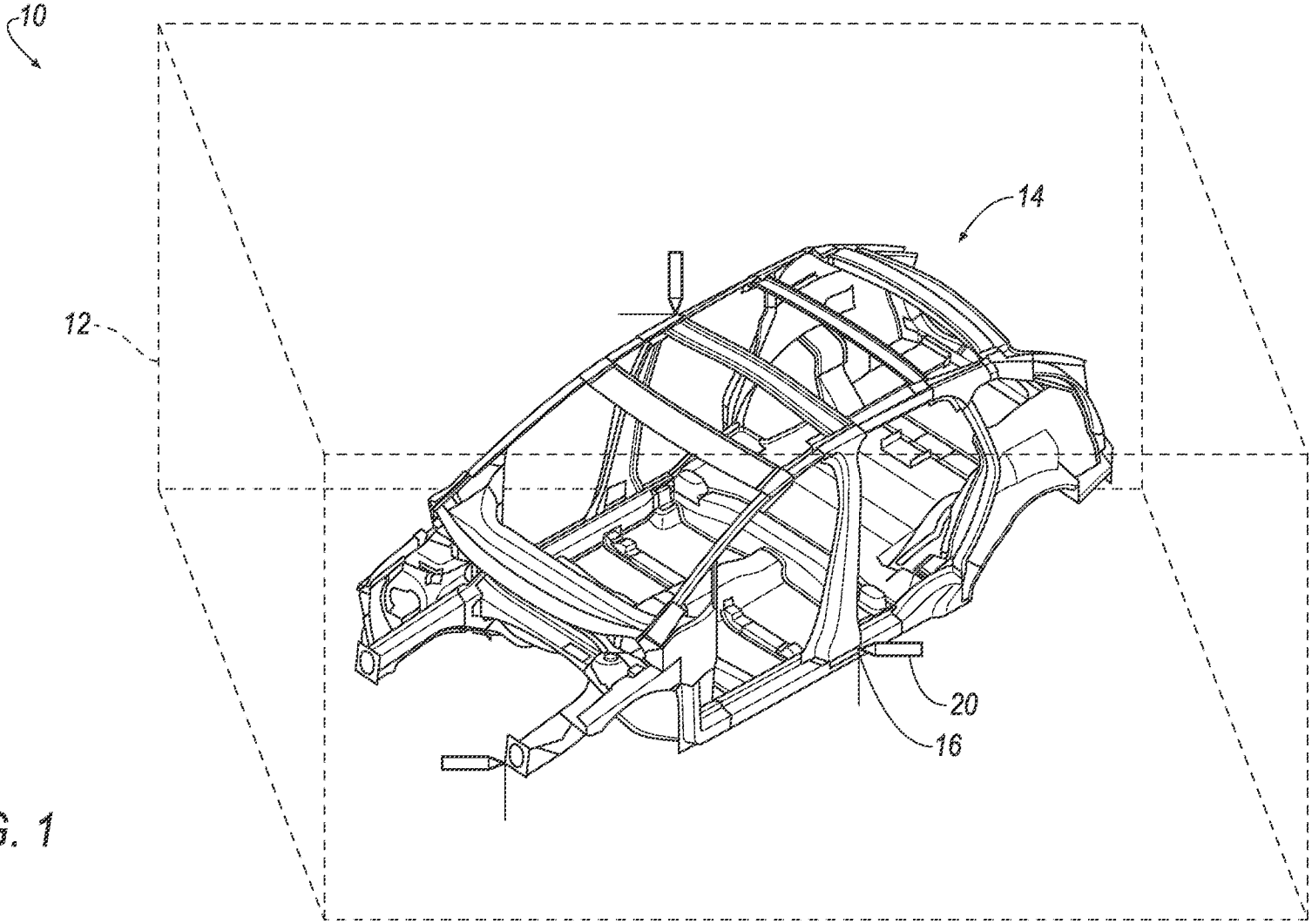
FIG. 1 is a view of an example system for forming a component for a vehicle body.

FIG. 1 illustrates a system 10 for forming a weldless component for a vehicle body. Note that, although the present subject matter is described with respect to components of a vehicle body, the principles disclosed herein could be applied in other contexts, e.g., to form components of some or all of other equipment, e.g., a motorcycle body, a bicycle frame, watercraft, aircraft, and/or other complex machines, regardless of whether used for transportation, but comprising multiple components that are presently welded or otherwise conventionally joined together.

The system 10 includes a chamber 12, a vehicle component 14, a rotatable mount 18 (not shown), and an injector 20. The injector 20 is provided deposit material to form edges 16. Such material could include, e.g., steel, copper, aluminum, polymer, composite materials, etc., the edges 16 building layers to form the vehicle component 14. An "edge." as that term is used herein, means an outermost layer of solidified material. i.e., the injector 20 deposits a layer of material onto a component 14 being formed, that outermost layer then solidifying into the edge 16.

The chamber 12 may be, e.g., a chamber in a manufacturing facility held at a specified temperature. The chamber 12 may include a heater 38 to heat the chamber 12. The specified temperature may be, e.g., below the melting temperature of the materials to construct the component 14 to control the temperature of the material in the injector 20. The specified temperature may also be a temperature that allows for particular material characteristics for the layers of material when cooled.

The vehicle component 14 may be any part of a vehicle body that may be formed in the heated chamber 12. e.g., a chassis, a pillar, a rocker panel, a floor pan, etc. The vehicle component 14 may be partially formed before being provided to the system 10, whereupon the injector 20 supplements and/or completes formation of the component 14. Alternatively, or the injector 20 may form the entire component 14. A plurality of components 14 may be formed simultaneously or substantially simultaneously. e.g., such that some or all of a vehicle body is formed at a same time.

Because the component 14 is formed, typically solely, of layers of material, the vehicle component 14 may be weldless. Thus, a vehicle body built from weldless components 14 as disclosed herein may have significantly fewer or no welds than a conventional vehicle body. Advantageously, a weldless component 14 may have a higher stiffness, corrosion resistance, and durability, and/or material composition that differ from conventional stamped and welded components 14. Further, the weldless component 14 may be formed at a lower cost and/or in a faster time than conventional components 14 compared to, e.g., conventional components 14 formed by stamping several parts, shipping the parts, storing the parts, and then assembling the parts with spot welds.

The rotatable mount 18 secures the vehicle component 14 during its formation. The rotatable mount 18 may be arranged in a known manner to rotate the component in any of X, Y, and Z axes, i.e., in three dimensions, to allow the injector 20 to form the edge 16 along any surface of the vehicle component 14. The rotatable mount 18 may position the component 14 to, e.g., allow the injector 20 to deposit a layer of material with the aid of gravity. The vehicle component 14 may be partially formed before being introduced to the system 10, and the partially formed vehicle component 14 may be secured to the rotatable mount 18. For example, the component 14 may start as, e.g., a stamped bed formed from a sheet of metal prior to introduction into the system 10. The component 14 may then be fixed to the rotatable mount 18 and the injector 20 may deposit layers onto the stamped bed, forming edges 16 that produce parts of the fully formed component 14, where a "part" is an individual subsection of a component, such that all of the "parts" comprise the fully formed component. Alternatively, the component 14 may be formed entirely on the rotatable mount 18, i.e., the component 14 is formed solely of deposited layers of material without a partially formed component 14. In such a construction, the injector 20 may deposit layers of material onto a flat part of selected material attached to the rotatable mount 18 at first, until the injector 20 forms enough parts, i.e., subsections, of the component 14 to start depositing layers of material directly onto the component 14.

Figure 2A:
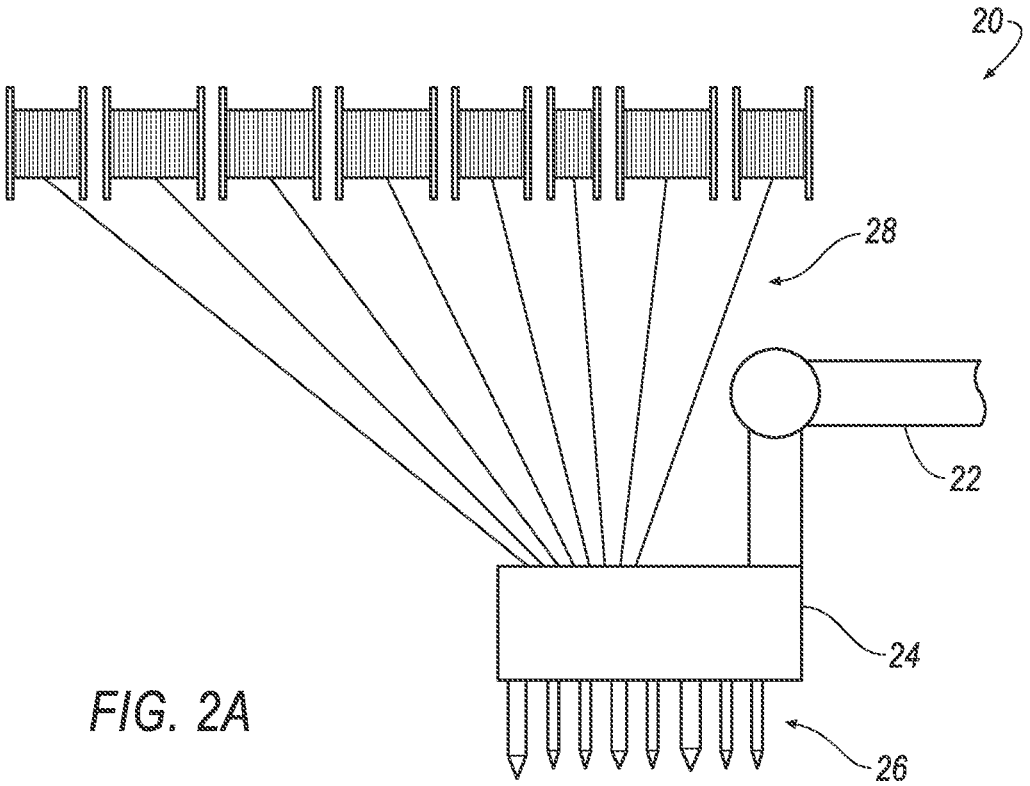
FIG. 2A is a view of an example injector for forming a component.
Figure 2B:
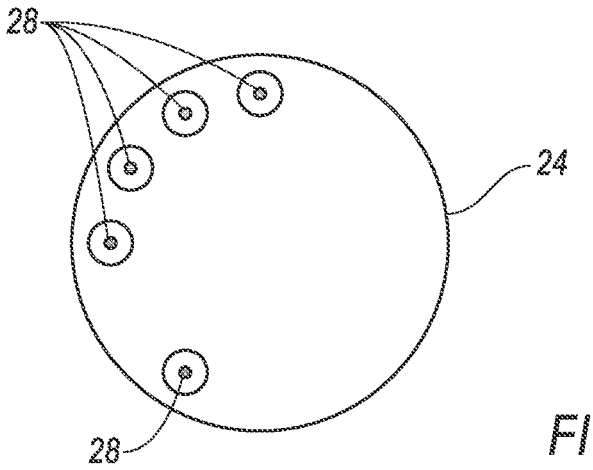
FIG. 2B is an expanded view of an example housing of the injector of FIG. 2A.

FIGS. 2A-2B illustrate the injector 20. The injector 20 includes a robotic arm 22, a rotatable injector housing 24, at least one injector head 26, and at least one material feed 28. The injector 20 deposits a layer of material that hardens into an edge 16. The system 10 may include a plurality of injectors 20. e.g., arranged in the chamber 12 to deposit layers of material onto the component 14.

The robotic arm 22 may be an apparatus that is movable in three dimensions around the component 14, e.g., having a plurality of rigid segments joined by flexible joints, e.g., universal joints. The robotic arm 22 may include a rotatable injector housing 24, e.g., a cylindrical housing including slots to house a plurality of injector heads 26 rotatably connected to the robotic arm 22. The robotic arm 22 positions the injector head 26 to deposit the layers of material to build the vehicle component 14. The injector heads 26 may be fixed to the rotatable injector housing 24 or may be attachable to the housing 24.

The rotatable injector housing 24 includes a plurality of injector heads 26, each injector head 26 receiving at least one material feed 28. The rotatable injector housing 24 may rotate when a particular material, and hence a particular injector head 26 and material feed 28, is required for a layer. Thus, the vehicle component 14 may be formed with a plurality of distinct material layers of a same material and/or different materials deposited sequentially from a same robotic arm 22. In a simple example, the rotatable injector housing 24 could rotate to allow first and second injector heads 26 having respective first and second material feeds 28 to deposit respective layers of material onto the component 14. As shown in FIG. 2B, the material feeds 28 may feed into the top of the injector heads 26 mounted to the rotatable injector housing 24. The injector 20 may include a plurality of rotatable injector housings 24. The injector 20 may include a plurality of rotatable injector housings 24 carrying injector heads 26. While the rotatable injector housing 24 is shown in a substantially circular shape in FIG. 2, the rotatable injector housing 24 may be any suitable shape, as is known, e.g., ovular, rectangular, etc.

Figure 3:
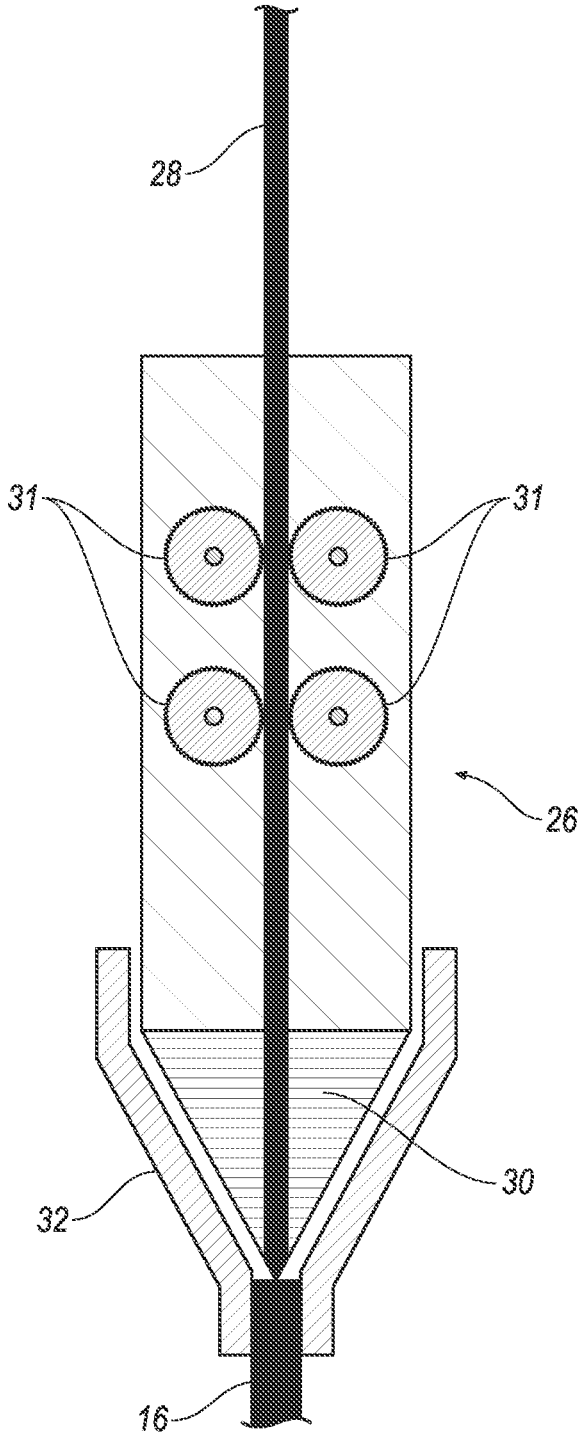
FIG. 3 is a view of an example injector head of the injector of FIG. 2A.

FIG. 3 illustrates an example injector head 26. The injector head 26 includes the material feed 28, a heating element 30, a feeding mechanism 31, and an edge guide 32. The injector head 26 may be configured to attach to the rotatable injector housing 24. The injector head 26 feeds layers of material to the component 14 by, e.g., laying or spraying molten material that hardens into the edge 16.

The material feed 28 provides material to deposit a layer to harden into the edge 16 that builds the vehicle component 14. The material feed 28 may be, e.g., a metal including copper, steel, aluminum. etc. wires, a polymer including plastic wires, a composite material. Further a same material in different material feeds 28, e.g., steel wire of first and second thicknesses, e.g., gauges, could be used in first and second material feeds 28. By rotating between two or more injector heads 26 with two or more respective material feeds 28, a component 14 may be formed from different materials that normally could or would not be joined, e.g., steel and aluminum, which may not be welded together. A speed of the injector head 26 may be adjusted based on a particular material feed 28, injector 20 travel path, geometry of the edge 16, etc. to deposit respective layers of material at a consistent thickness. The material feeds 28 may be, e.g., spools of metal wires arranged to avoid entanglement of the metal wires when fed into the injector head 26, or a powder, e.g., a metallic powder, delivered through a flexible tube or pipe. Other injector heads 26 may apply chemical additives, e.g., known additives such as flux, binders, etc., along the deposited layer near ahead or near behind the injector head 26 depositing the material 28. The chemical additives may aid the hardening of the material 28 into the edge 16. For example, the injector 20 may include one injector head 26 depositing molten metal and another injector head 26 depositing flux. In another example the chemical additive may be applied with a second injector 20. Still other injector heads 26 may not deposit material at all, but simply heat or cool the material 28 as it forms the edge 16 to, e.g., prevent molten material 28 from dripping. The material feeds 28 may include. e.g., steel alloys, aluminum alloys, copper alloys, plastics, etc.

The heating element 30 heats the material feed 28 to a specified temperature. The specified temperature may be the melting point of the material in the material feed 28, or a temperature that renders the material feed pliable enough to form the edge 16. e.g., the material is plastically deformable. The heating element 30 may be an electrical heating coil, a laser heater, or other suitable heating mechanism. The temperature of the heated chamber 12 may be varied to facilitate the melting and depositing of the material feed 28.

The injector head 26 may include the feeding mechanism 31 to hold and feed the material feed 28 at a selected speed. For example, the feeding mechanism 31 may grip that material feed 28, e.g., a metal wire, and pull the material 28 into the heating element 30.

The edge guide 32 directs the heated material feed 28 to deposit the layer of material to harden into the edge 16. The edge guide 32 may be shaped for a specific material feed 28. For example, based on the material 28 thickness, gauge, heat capacity, density, and/or viscosity, the edge guide 32 may be shaped to produce a desired shape of an edge 16. The edge guide 32 may be arranged to form a desired shape of a layer of material onto the component 14 to form desired shapes of edges 16. The edge guide 32 may be arranged to deposit a consistent layer of material, e.g., a layer of material that is substantially the same thickness throughout. The edge guide 32 may be rigidly fixed to the injector head 26 or detachable from the injector head 26. By depositing layers of material to form the component 14, the component 14 may be formed without the use of welds or other fasteners. The edge guides 32 may be coated with a nonstick coating, as is known, selected to repel and/or be nonreactive with the molten material 28 so that the molten material 28 does not harden on the edge guides 32.

Figure 4A:
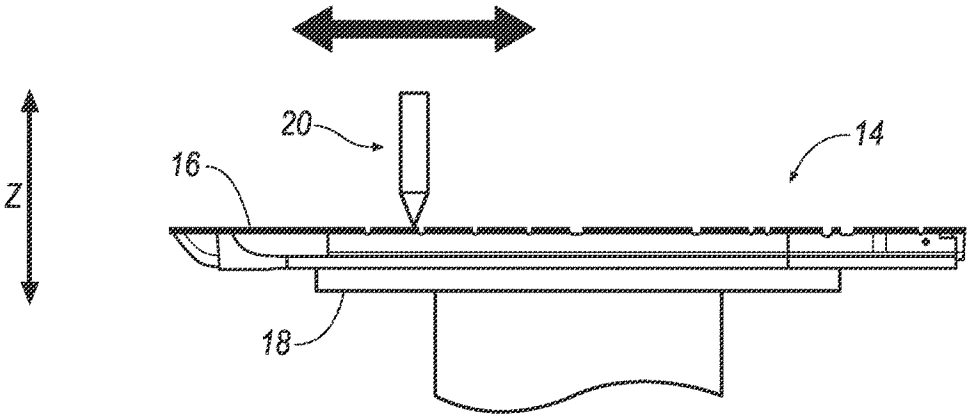
FIG. 4A is a view of the system of FIG. 1 forming a component.
Figure 4B:
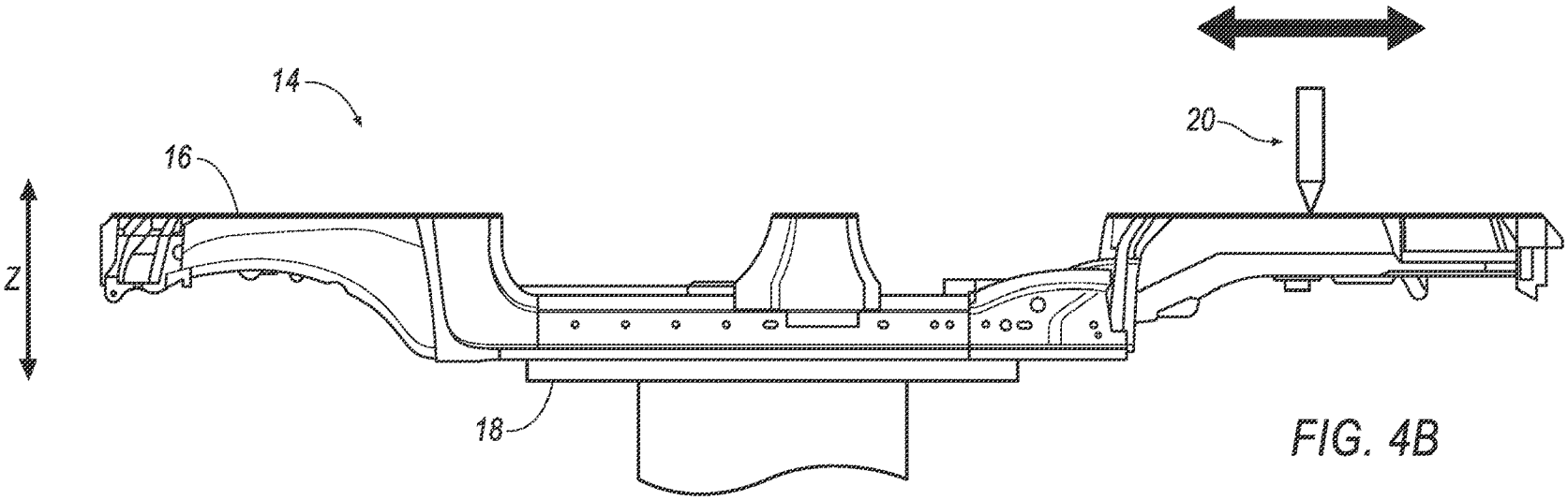
FIG. 4B is a view in which the system of FIG. 1 has formed parts of the component.

FIG. 4A-4B illustrate an exemplary vehicle component 14 formed with one or more injectors 20. As shown in FIG. 4A, the component 14 sits on the mount 18, and an injector 20 travels along the component 14 depositing layers of material to form the edges 16. As shown in FIG. 4B, the edges 16 form respective portions of the component 14. The injector 20 deposits layers of material onto the component 14, building edges 16 that result in parts of the finished component 14. For example, as shown in FIG. 4A, where the component 14 starts substantially flat, parts of the component 14 are constructed by the injector 20 having varying heights along the component 14, as shown in FIG. 4B. In this example, the component 14 is positioned so that a Z-axis of the component 14 is vertical, i.e., oriented with the bottom or top of the component 14 facing in the direction of gravity. Thus, the injector 20 may move in the X and Y axes to deposit layers of material to form parts of any particular shape in the X and Y directions.

FIGS. 5A-5B illustrate another example vehicle component 14 formed with the injector 20. Formation of some parts of the component 14 may require a plurality of distinct orientations of the mount 18. In this example, the component 14 is positioned so that an X-axis of the component 14 is vertical, i.e., oriented such that a front or rear of the component 14 is facing in the direction of gravity. In this example, the component 14 may be, e.g., a chassis and/or other component of a rear of a vehicle. Because the injector 20 may deposit layers of material in a vertical direction, i.e., down from the injector head 26 onto the component 14, components 14 that require parts formed in other orientations may require the component 14 to be rotated to allow formation of the part of the component 14. In this example, because the component 14 may extend in the X-axis, the component 14 must be rotated so that the injector 20 may deposit layers of material to form edges 16 along the X-axis. As shown in FIG. 5B, the injector 20 forms edges 16 that form parts of the component 14 that extend in the X-axis. The component 14 may thus have more complex parts formed without requiring welding of an additional part.

Figure 6:
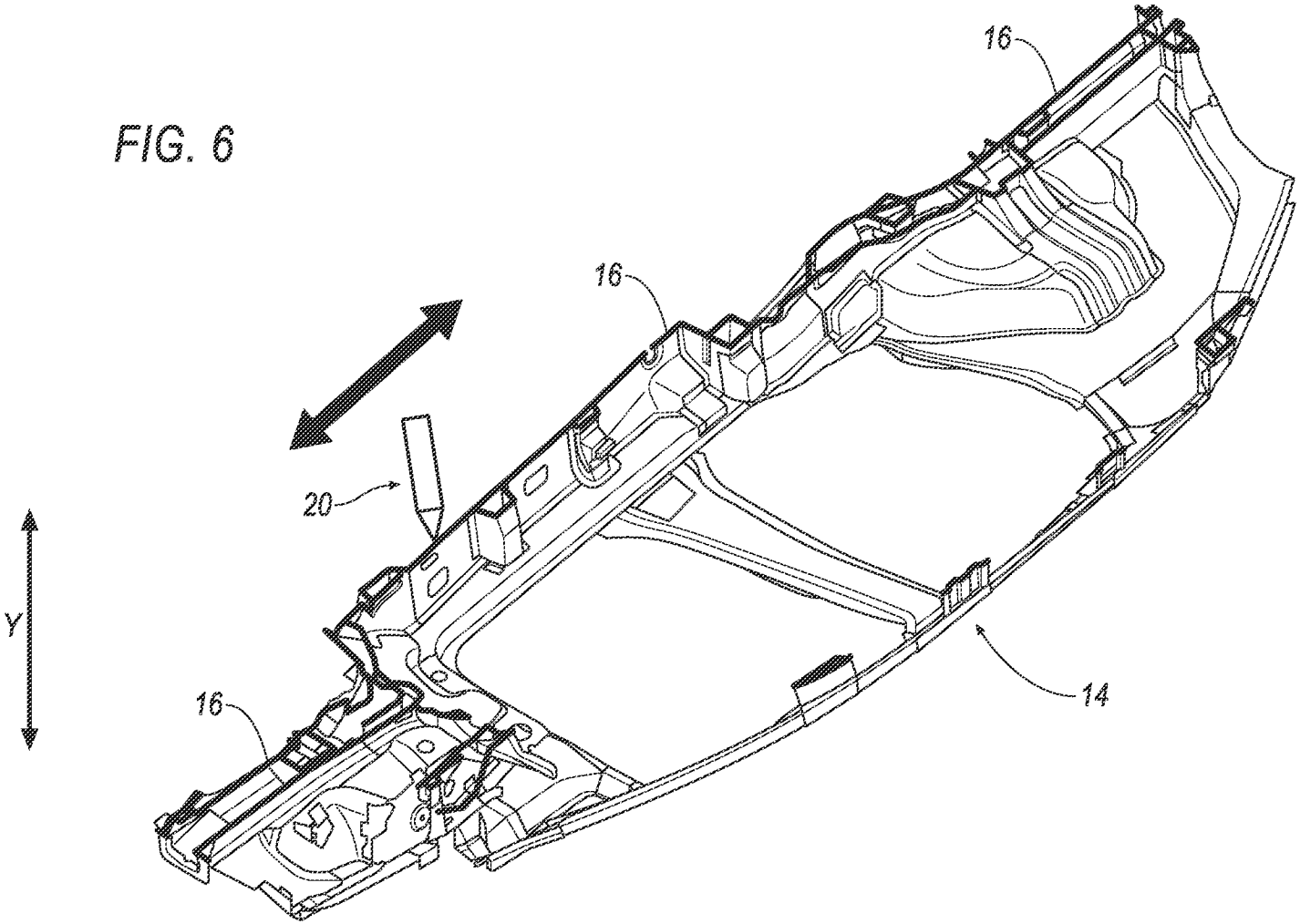
FIG. 6 is a view of the system of FIG. 1 forming a component where the component is rotated such that its Y-axis is vertical.

FIG. 6 illustrates another example vehicle component 14 formed with the injector 20. In this example, the component 14 is formed so that a Y-axis of the component 14 is vertical, i.e., oriented such that a left side or a right side of the component 14 is facing in the direction of gravity. The injector 20 may deposit layers of material along the component 14 to form parts in the direction of the Y-axis. The component 14 may be rotated along any of the X, Y, and Z axes so that the part to be formed may face vertically to receive the material from the injector 20.

Figure 7:
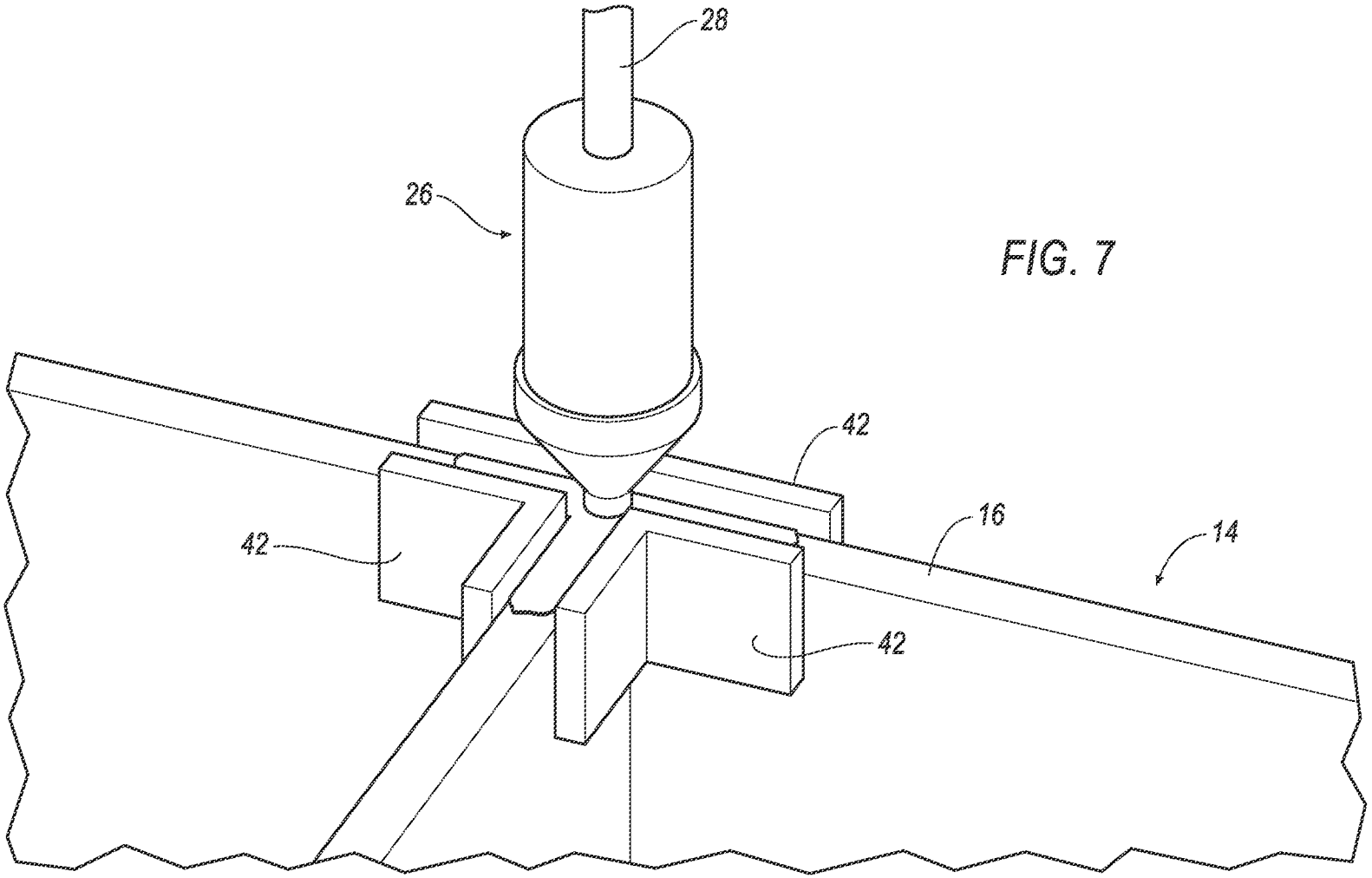
FIG. 7 is a view of the system of FIG. 1 forming a component where two parts of the component form a 3-way intersection.

FIG. 7 illustrates an intersection of at least two parts of the component 14. An "intersection" refers to when three or more edges 16 of at least two parts of the component 14 contact. The injector head 26 is programmed to deposit layers of material 28 over the edges 16 to form a single edge 16 at the intersection, the single edge 16 being homogeneous. Here, the two parts form a 3-way intersection, i.e., the parts meet such that the edges 16 of the parts extend in three directions from an intersection point. At the intersection, guide plates 42 may be positioned to secure the edges 16 into place while the injector head 26 deposits material 28 to fuse the parts. That is, the two parts become a single part as layers of material are deposited into a single edge 16 that connects what were previously two edges 16. The guide plates 42 may be coated with a nonstick coating, as is known, selected to repel and/or be nonreactive with the molten material 28 so that the molten material 28 does not harden on the guide plates 42. The guide plates 42 may be secured to the component 14 by, e.g., a robotic arm holding the guide plates 42 stationary while the injector head 26 deposits the layers of material 28. The edge guide 32 may be removed from the injector head 26 when the guide plates 42 are used in the intersection. In this example, a single injector head 26 travels along the edges 16 of the two parts, depositing layers of material 28.

Figure 8:
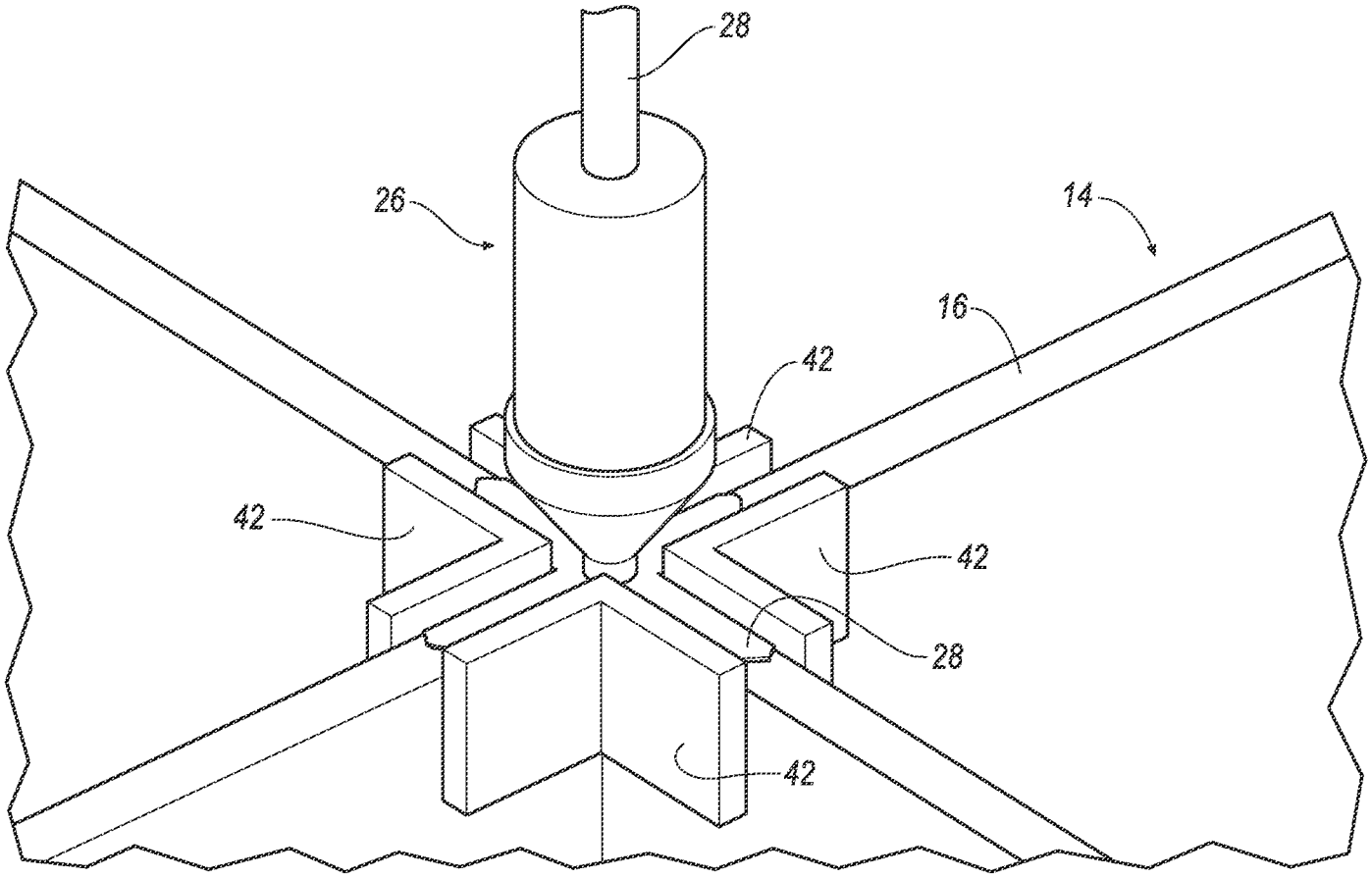
FIG. 8 is a view of the system of FIG. 1 forming a component where two parts of the component form a 4-way intersection.

FIG. 8 illustrates another example intersection of at least two parts of the component 14. Here, the parts form a 4-way intersection, i.e., the parts contact such that the edges 16 of the parts extend in four directions from an intersection point. The guide plates 42 may be positioned to secure the edges 16 into place while the injector head 26 deposits layers of material 28 to fuse the parts. In this example, a single injector head 26 deposits the layers of material 28 to form the edge 16 and fuse the parts. As above, the edge guide 32 may be removed from the injector head 26 when the plates guide 42 are used in the intersection.

Figure 9A:
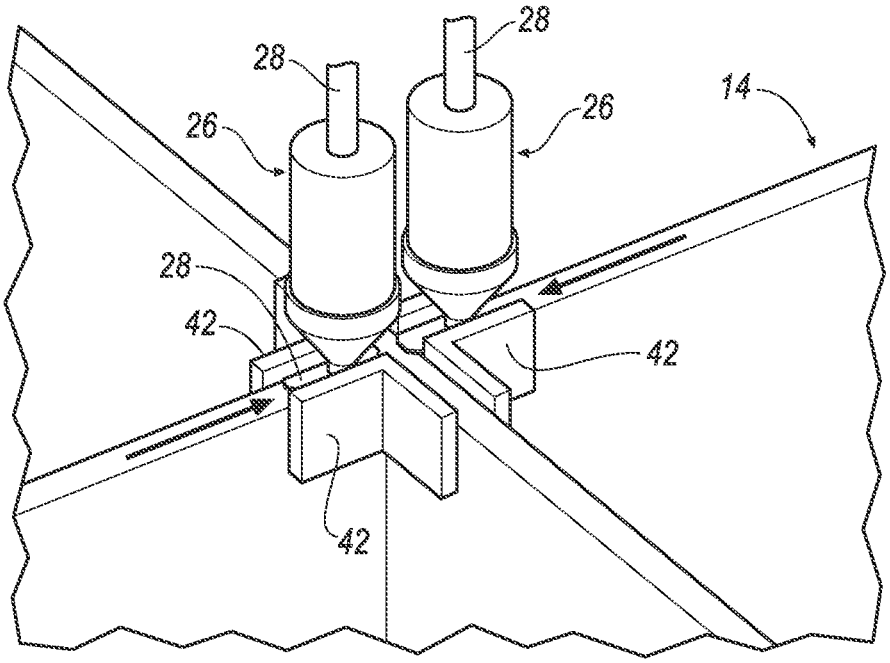
FIGS. 9A-9B is another view of the system of FIG. 1 forming a component where two parts of the component form a 4-way intersection.
Figure 9B:
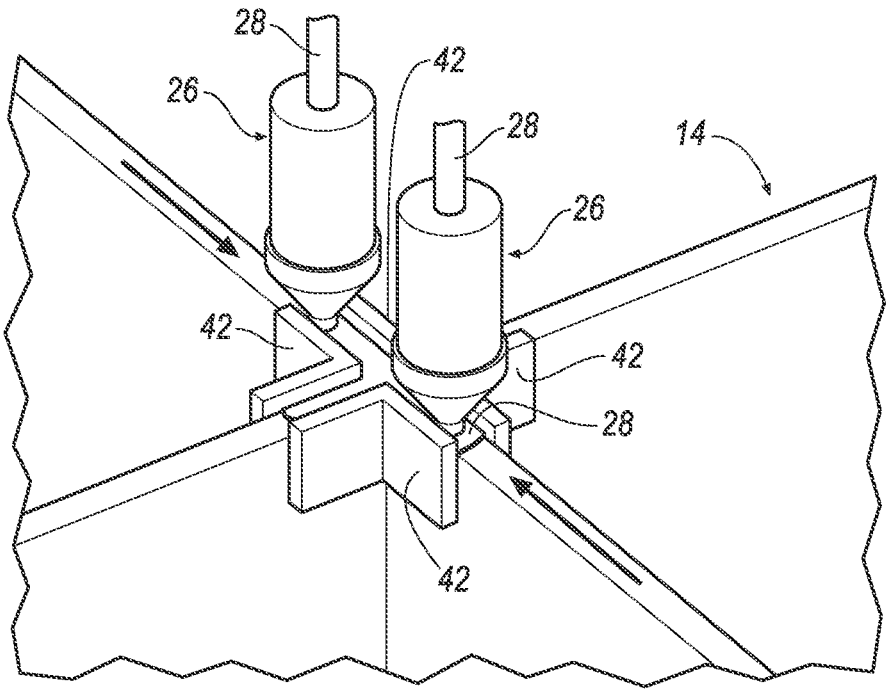

FIGS. 9A and 9B illustrate another example intersection of at least two parts of the component 14. The parts form a 4-way intersection around an intersection point. The plates 42 may be positioned to secure the edges 16 into place. In this example, two injector heads 26 deposit layers of material 28 in opposing directions toward the intersection point, as shown in FIG. 9A. Then, as shown in FIG. 2B, the two injector heads 26 deposit layers of material 28 along the other two opposing directions toward the intersection point. Using two injector heads 26 fuses the parts more quickly and may allow the resulting single edge 16 to harden more evenly, improving the strength of the edge. As above, the edge guides 32 may be removed from the respective injector heads 26 when the guide plates 42 are used in the intersection. Furthermore, the guide plates 42 as shown in FIGS. 7-9B may be attached to the injector 20.

Figure 10:
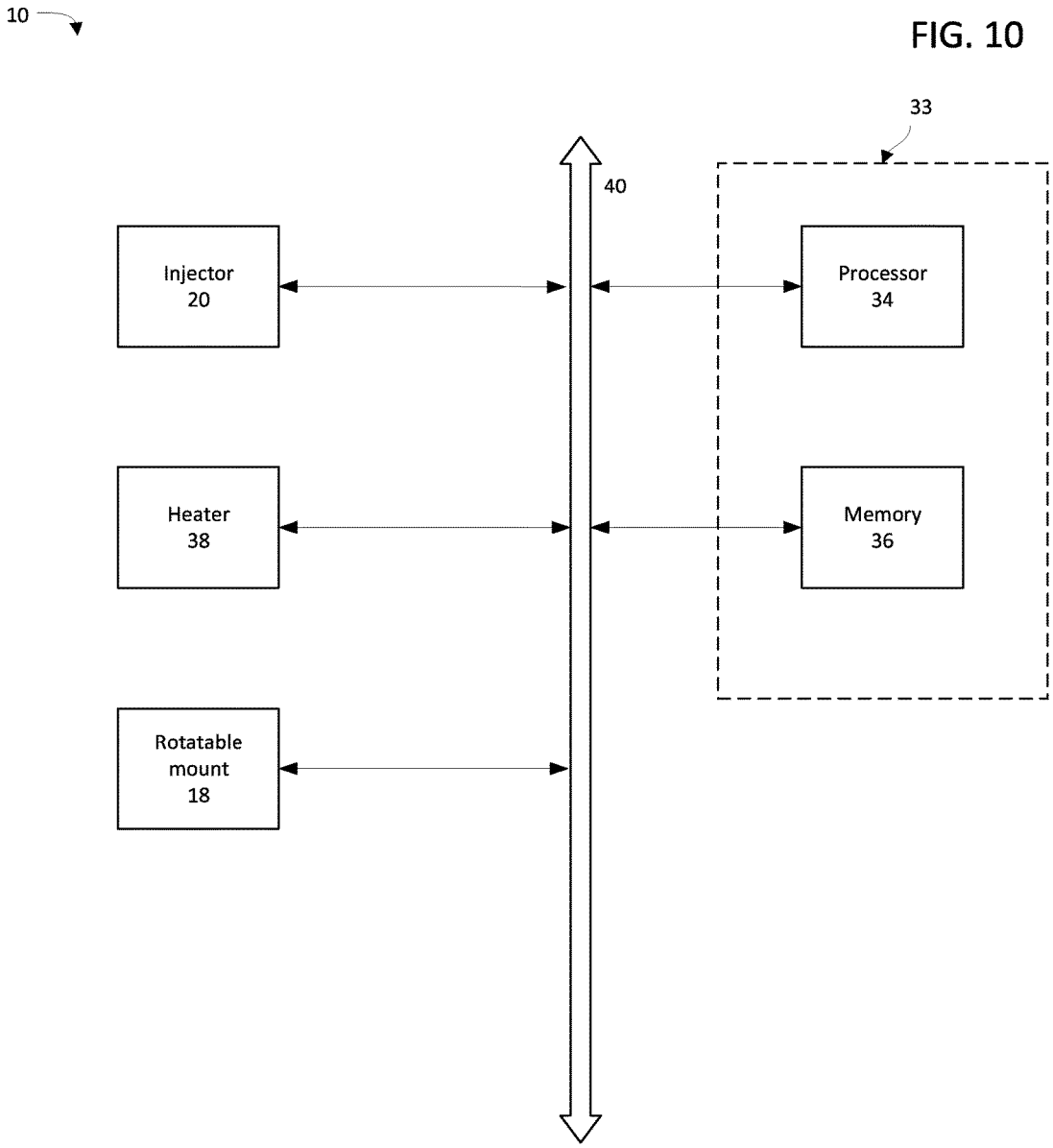
FIG. 10 is a block diagram of the system of FIG. 1.

FIG. 10 illustrates a block diagram of an example system 10. The system 10 includes the rotatable mount 18, the injector 20, a controller 33 that includes a processor 34 and a memory 36, the heater 38, and a communication bus 40, such as a controller area network (CAN) bus. The bus 40 communicatively couples the rotatable mount 18, the injector 20, the controller 33, and the heater 38, and allows the controller 33 to transmit instructions to actuate the rotatable mount 18, the injector 20, and the heater 38. The memory 36 stores instructions executable by the processor 34. The rotatable mount 18 includes a motor, e.g., an electric motor such as is known, that may be actuated in a known manner by the controller 33 to rotate and move the mount 18 in X, Y, and/or Z directions. The injector 20 includes at least one motor that may be actuated by the controller 33 in a known manner to move the injector 20 in X, Y, and/or Z directions. The controller 33 may actuate the heater 38. e.g., a plurality of heating coils and elements, in a known manner to heat the chamber 12 to the specified temperature. The chamber 12 may include a cooling system to cool the chamber to the desired temperature.

Figure 11:
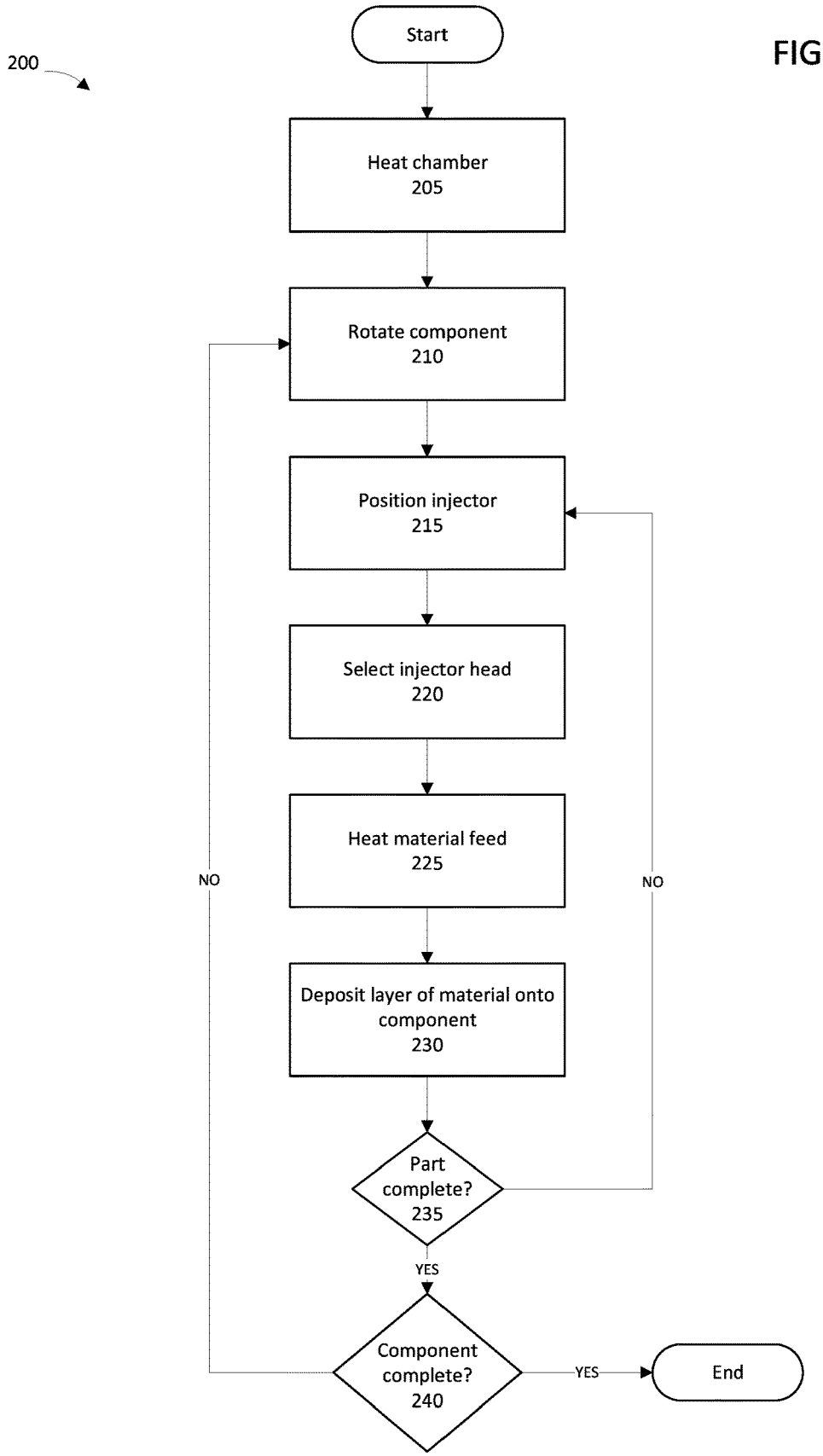
FIG. 11 is a flow chart of an example process for forming a component.

FIG. 11 illustrates an example process 200 for forming the component 14. The process 200 begins in a block 205, in which the controller 33 sends an instruction to the heater 38 to heat the chamber 12 to the specified temperature. The specified temperature may be defined as described above, and may generally be a temperature that is suitable for depositing the layer of material.

Next, in a block 210, the controller 33 sends an instruction to the rotatable mount 18 to rotate the component 14 so that the part to be formed is facing vertically. The rotatable mount 18 may rotates in any of the X. Y, and Z axes depending on the location of the part to be formed.

Next, in a block 215, the controller 33 sends an instruction to the injector 20 to move the robotic arm 22 and the rotatable injector housing 24 to position the injector head 26 toward the component 14. The robotic arm 22 may configured to move in three dimensions to position the injector head 26 in the location required to continue forming the component 14.

Next, in a block 220, the controller 33 sends an instruction to the rotatable injector housing 24 to rotate until the desired injector head 26 and material feed 28 is positioned over the component 14. The material feed 28 required for the current layer may be different than the material feed 28 used in the previous layer, e.g., a different thickness of the same material (e.g., steel) or a different material entirely (e.g., from steel to aluminum). The rotatable injector housing 24 may rotate until the needed material feed 28 is present. The rotatable injector housing 24, injector head 26, and material feed 28 may be moved so that the wires included in the material feeds 28 do not tangle.

Next, in a block 225, the controller 33 sends an instruction to the heating element 30 to heat the material feed 28. The heating element 30 heats the material feed 28 to a specified temperature dependent on the specific material in the material feed 28.

Next, in a block 230, the controller 33 sends an instruction to the robotic arm 22 to move the injector head 26 to deposit a layer of material form the material feed 28 to form the edge 16 on the component 14. The robotic arm 22 may move the injector head 26 at a speed necessary to ensure a consistent layer of material forming the edge 16; the speed may differ depending on the material feed 28. For example, if the heated material feed 28 has a higher viscosity, the robotic arm 22 may move the injector head more slowly, while a material feed 28 with a lower viscosity may allow for the robotic arm to move the injector head more quickly.

Next, in a block 235, the controller 33 determines whether the part of the component 14 is complete. The controller 33 includes hardware and software for computer-aided design and manufacturing (CAD/CAM). The controller 33 may include a 3-dimensional digitized image of the component 14 stored in the memory 36. The digitized image of the component 14 may be constructed using known techniques, e.g., CAD, 3D modeling, a 3-dimensional scanner, etc. The digitized image may include the material layers that the injector 20 must deposit to form the component 14. The controller 33 instructs the injector 20 to deposit the layers according to the image until the specific part of the component 14 is fully built. The CAD/CAM software may indicate when the part is completed. The software may include 3-dimensional images or blueprints of the component 14 including a list of each individual layer to be deposited, the location of the depositing of each layer, and the order in which to deposit the layers. If the part is not complete, the process 200 returns to the block 215 to lay another layer of material. Otherwise, the process 200 continues in a block 240.

In the block 240, the controller 33 determines whether the component 14 is complete. The controller 33 may refer to the plan to determine whether all of the parts of the component have been formed, indicating completion of the component 14. If the component 14 is not complete, the process 200 returns to the block 210 to form the next part. Otherwise, the process 200 ends.

As used herein, the adverb "substantially" modifying an adjective means that a shape, structure, measurement, value, calculation, etc. may deviate from an exact described geometry, distance, measurement, value, calculation, etc., because of imperfections in materials, machining, manufacturing, sensor measurements, computations, processing time, communications time, etc.

Computing devices generally each include instructions executable by one or more computing devices such as those identified above, and for carrying out blocks or steps of processes described above. Computer-executable instructions may be compiled or interpreted from computer programs created using a variety of programming languages and/or technologies, including, without limitation, and either alone or in combination, Java™, C, C++, Visual Basic, Java Script, Perl, HTML, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media. A file in the computing device is generally a collection of data stored on a computer readable medium, such as a storage medium, a random access memory, etc.

A computer-readable medium includes any medium that participates in providing data (e.g., instructions), which may be read by a computer. Such a medium may take many forms, including, but not limited to, non-volatile media, volatile media, etc. Non-volatile media include, for example, optical or magnetic disks and other persistent memory. Volatile media include dynamic random access memory (DRAM), which typically constitutes a main memory. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, or any other medium from which a computer can read.

With regard to the media, processes, systems, methods, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. For example, in the process 200, one or more of the steps could be omitted, or the steps could be executed in a different order than shown in FIG. 11. In other words, the descriptions of systems and/or processes herein are provided for the purpose of illustrating certain embodiments, and should in no way be construed so as to limit the disclosed subject matter.

Accordingly, it is to be understood that the present disclosure, including the above description and the accompanying figures and below claims, is intended to be illustrative and not restrictive. Many embodiments and applications other than the examples provided would be apparent to those of skill in the art upon reading the above description. The scope of the invention should be determined, not with reference to the above description, but should instead be determined with reference to claims appended hereto and/or included in a non-provisional patent application based hereon, along with the full scope of equivalents to which such claims are entitled. It is anticipated and intended that future developments will occur in the arts discussed herein, and that the disclosed systems and methods will be incorporated into such future embodiments. In sum, it should be understood that the disclosed subject matter is capable of modification and variation.

The invention claimed is:

1. A system for forming a vehicle component, comprising:
an injector including a robotic arm and an injector head;
a pair of removable guide plates; and
a heated chamber;
wherein the injector includes a material feed and a heater, the robotic arm disposing the injector head between the guide plates to deposit the material feed onto the vehicle component in the heated chamber, and each guide plate is L-shaped and disposed at a corner of an intersection of edges of the vehicle component to guide the material feed along the edges at the intersection, the injector head disposed between the guide plates at the intersection of edges to deposit the material feed.

2. The system of claim 1, wherein the injector is arranged to deposit a layer of material from the material feed.

3. The system of claim 2, wherein the injector is arranged to deposit a plurality of layers onto the component.

4. The system of claim 3, wherein the component is arranged to be rotated and the injector is configured to deposit the layer of material on the rotated component.

5. The system of claim 1, wherein the component is weldless.

6. The system of claim 2, wherein the injector is arranged to deposit at least one of an extruded layer of metal, droplets of liquid metal, and a spray of liquid metal.

7. The system of claim 6, wherein the injector includes an edge guide for forming an edge from the deposited metal.

8. The system of claim 1, wherein the robotic arm includes a plurality of injector heads including a plurality of material feeds, the material feeds including at least one of a steel, a polymer, an aluminum, and a chemical additive.

9. The system of claim 8, wherein the robotic arm includes a rotatable injector housing, the plurality of injector heads installed in the rotatable injector housing.

10. The system of claim 1, further comprising a second injector, the second injector including a chemical additive, wherein the second injector is arranged to deposit the chemical additive onto the component.

11. The system of claim 1, wherein the material feed is at least one of a metal wire and a powder.

12. The system of claim 1, wherein the injector includes a feeder arranged to feed the material feed to the heater.

13. The system of claim 1, wherein at least one robotic arm is arranged to deposit a layer of liquid material from the material feed over the intersection and form a single edge upon solidifying.

* * * * *